United States Patent [19]

Gottstein

[11] 4,456,298

[45] Jun. 26, 1984

[54] APPARATUS FOR STEPWISE ADJUSTMENT OF SEPARATION BETWEEN TWO CHAIR PORTIONS

[75] Inventor: Emil Gottstein, Albbruck, Fed. Rep. of Germany

[73] Assignee: Martin Stoll GmbH, Fed. Rep. of Germany

[21] Appl. No.: 311,884

[22] Filed: Oct. 15, 1981

[30] Foreign Application Priority Data

Oct. 15, 1980 [DE] Fed. Rep. of Germany ..... 3038880

[51] Int. Cl.[3] ..... A47C 1/00

[52] U.S. Cl. ..... 297/353; 108/146; 248/409; 248/423; 403/108; 403/322

[58] Field of Search ..... 297/353, 410; 108/146; 248/157, 423, 188.5, 407–409; 403/108, 322

[56] References Cited

U.S. PATENT DOCUMENTS

| | | | |
|---|---|---|---|
| 325,044 | 8/1885 | Blackburn | 248/409 |
| 3,802,658 | 4/1974 | Binding | 248/409 X |
| 4,036,525 | 7/1977 | Howk | 297/353 |
| 4,043,592 | 8/1977 | Fries | 297/353 X |
| 4,221,430 | 9/1980 | Frobose | 297/353 |

FOREIGN PATENT DOCUMENTS 2163171 7/1973 Fed. Rep. of Germany .

*Primary Examiner*—William E. Lyddane
*Attorney, Agent, or Firm*—Kenway & Jenney

[57] ABSTRACT

Mechanism for stepwise adjustment of the distance between a primary element, attached to one part of a chair, and a secondary element attached to another part, characterized by: (a) two stop slides mounted on the primary element to slide in the direction perpendicular to the adjustment direction, between an opening position and a locking position, (b) a number of stop recesses in each stop slide, one above another in the adjustment direction, placed on a first side of each stop slide which faces the other stop slide, and open to the first side, with the stop recesses of the two stop slides lying opposite one another in pairs, (c) an elastic element for pushing the stop slides into the locking position, (d) a bolt passing between the stop slides, perpendicular to the adjustment direction and to the direction of displacement of the stop slides attached to the secondary element, and (e) a spreader mechanism with a mover mounted on the primary element such that it can be shifted parallel to the adjustment direction to displace the stop slides out of the locking position into an opening position with the paired stop recesses of the stop slides in the locking position engaging the bolt from both sides, while in the opening position the bolt can be moved parallel to the adjustment direction between the stop slides.

19 Claims, 8 Drawing Figures

APPARATUS FOR STEPWISE ADJUSTMENT OF SEPARATION BETWEEN TWO CHAIR PORTIONS

Figure 1:
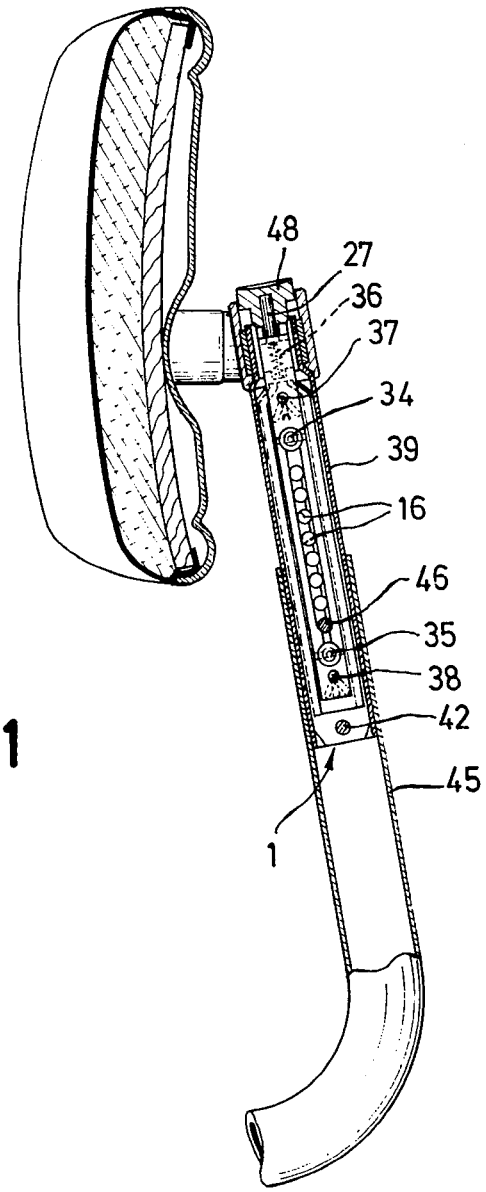

The invention concerns a mechanism for stepwise adjustment of the distance between a primary element attached to one part of a chair, and a secondary element attached to another part of the chair.

For the adjustment of the separation of various chair parts, for example for adjustment of the height of a back rest relative to the seat, a number of different mechanisms are already familiar. Most of these mechanism require substantial costs of construction, and have a large space requirement, so that it is difficult to design such adjustment mechanisms to be attractive in appearance as well as easily constructed and secure in operation.

The invention is found on the task of proposing a universal adjustment mechanism, which by simple means of construction enables a stop-notch adjustment of distance between two chair parts, with low construction cost and space requirements.

This task is accomplished according to the invention by a mechanism of the type described at the outset, characterized by:

(a) two stop slides on the primary element, mounted to slide perpendicular to the adjustment direction, between an opening position and a locking position;

(b) a number of stop recesses in each stop slide, one above another in the adjustment direction, placed on the side of each stop slide which is toward the other stop slide, and open to this side, so that the stop recesses of the two stop slides lie opposite one another in pairs;

(c) an elastic element for directly or indirectly pushing the stop slides into the locking position;

(d) a bolt passing between the stop slides, perpendicular to the adjustment direction and to the displacement direction of the stop slides, attached to the secondary element; and (e) a spreader mechanism, with a mover, mounted on the primary element, which can be shifted parallel to the adjustment direction, to displace the stop slides out of the locking position into the open position, with the paired stop recesses of the stop slides in the locking position engaging the bolt, while in the open position the bolt can be moved between the stop slides parallel to the adjustment direction.

The mechanism according to the invention consists of few parts, namely a primary element attached to one chair part, two stop slides, a mover displacing these, an elastic element, and a bolt passing between the stop slides, attached to the second chair part. Therefore the construction is extremely simple, while at the same time, through the advantageous interworking of these few parts, a secure and simple step adjustment is possible. For adjustment, it is sufficient to push the mover shaft, so that the two stop slides are pushed from the locking to the open position. In this position the bolt can be displaced between the two stop slides, and thus the distance between the two elements can be adjusted. Upon release of the mover shaft, the stop slides are brought back into the locking position under the action of the elastic element, with the stop recesses, open to one side of each stop slide, engaging the pin from both sides in the desired position, and thus fixing the two elements at the selected separation.

In an advantageous form of execution of the mechanism according to the invention, the mover of the spreader mechanism bears two lugs placed at a distance apart in the adjustment direction, which engage obliquely running keyways in the two stop slides. It is advantageous for the keyways to consist of slots in the stop slides, through which the lugs project.

In this way the two stop slides, mounted to slide on the first element, undergo a defined displacement along their guideways when the mover, sliding perpendicular to that displacement, is shifted.

It is advantageous for the lugs at the same time to pass through slots in the primary element, running parallel to the adjustment direction, so that in this way guidance of the mover shaft along the primary element is simultaneously ensured.

It is also advantageous for the elastic element to be a compression spring, bearing on the one hand on the mover, and on the other hand on the primary element. This spring pushes the mover constantly toward the position corresponding to the locking position of the stop slides, whereby through the engagement of the mover lugs with the keyways of the two stop slides, the latter are indirectly pushed toward the locking position.

For mounting of the stop slides, slots running perpendicular to the adjustment direction can be provided in them, through which pass studs attached to the primary element, which may preferably also pass through slots in the mover, running parallel to the adjustment direction. Thus these studs contribute as well to the guidance of the mover on the primary element.

In an advantageous form of execution, the primary element has the form of a long plate with a longitudinally running slot, the two stop elements also have the form of long plates, lying flat against opposite sides of the primary element, whereby in the locking position the projections between the stop recesses partly cover the slot in the primary element, and the mover is U-shaped, with two arms formed by long plates, lying flat against the stop slides at the outside, each having a slot aligned with the slot in the primary element.

This configuration enables an especially compact construction of the mechanism, and furthermore permits very economical manufacture of the component parts of the mechanism.

It is advantageous for the stop slides to have longitudinally running slots, one side of which bears the recesses open to the inside edge of the slot.

The stop slides are advantageously identical in construction, and installed in the mechanism in mirror image fashion.

The manufacture of parts is especially favorable if the primary element and stop slides are stamped sheet parts.

In a favorable fashion, the mover can also be constructed of stamped parts which form its two arms. At one end the arms are bent, and connected together along the bend ends.

In the shaft of the mover connecting the two arms, can favorably be installed a centering pin projecting into a compression spring bearing on the primary element. In addition, the primary element can have lateral flanges on its side toward the shaft, which retain the compression spring, bearing on the primary element, in the direction perpendicular to the adjustment direction. In the parallel direction, the compression spring is retained by the arms of the mover.

The mover bears a push button.

In an advantageous example of execution, the projections between the stop recesses have at their end a portion running perpendicular to the adjustment direction, and in the locking position, the stop slides are at such a distance from one another that the opening formed by the two stop recesses is bounded by these portions perpendicular to the adjustment direction.

For example, the recesses can have a semicircular shape, with adjoining straight line sections running to the edge of the stop slide, perpendicular to the adjustment direction. This advantageous arrangement ensures that the locking bolt enclosed by the recesses bears on portions of the stop slides which are perpendicular to the adjustment direction, so that the bolt, when subjected to load, cannot exert any force on the stop slide in the opening direction. In this way it is ensured that the adjustment will be maintained even under great load.

It is especially advantageous for the assembly of the primary element, stop slide and mover to be placed within a tubular component, and to be fixed within it by attachment of the primary element solidly to the tubular component, with diametric longitudinal slots provided in the tubular component for the bolt passing through the stop slides, and for the tubular component to telescope within the secondary element, also tubular. There thus results an especially favorable arrangement of the mechanism within the tubular component, which in turn is inserted in telescoping fashion into a tube. The entire mechanism is in this way enclosed within the two telescoping tubes, and components projecting to the outside are not necessary.

For attachment of the primary element, a pin can be provided, passing through the opposing holes in the tubular component and through a hole in the primary element. It is advantageous that the tubular component be open at the end away from the secondary element, so that the mover can be pushed, through the open end.

In an advantageous example of execution, a chair back rest can be attached directly or indirectly to the primary element, while the second element is directly or indirectly attached to the chair. The mechanism then serves for adjustment of the height of the back rest relative to the seat.

Figure 2:
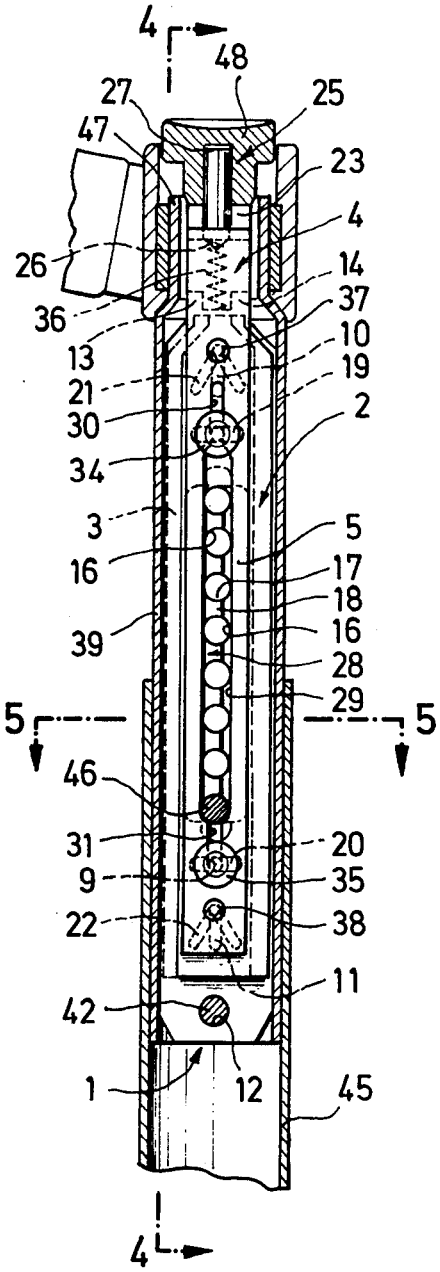
Figure 3:
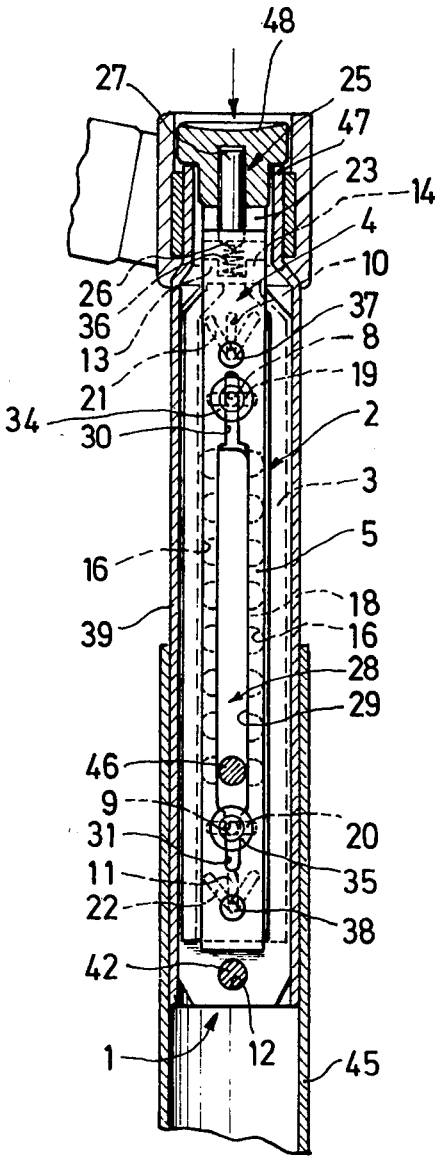
Figure 4:
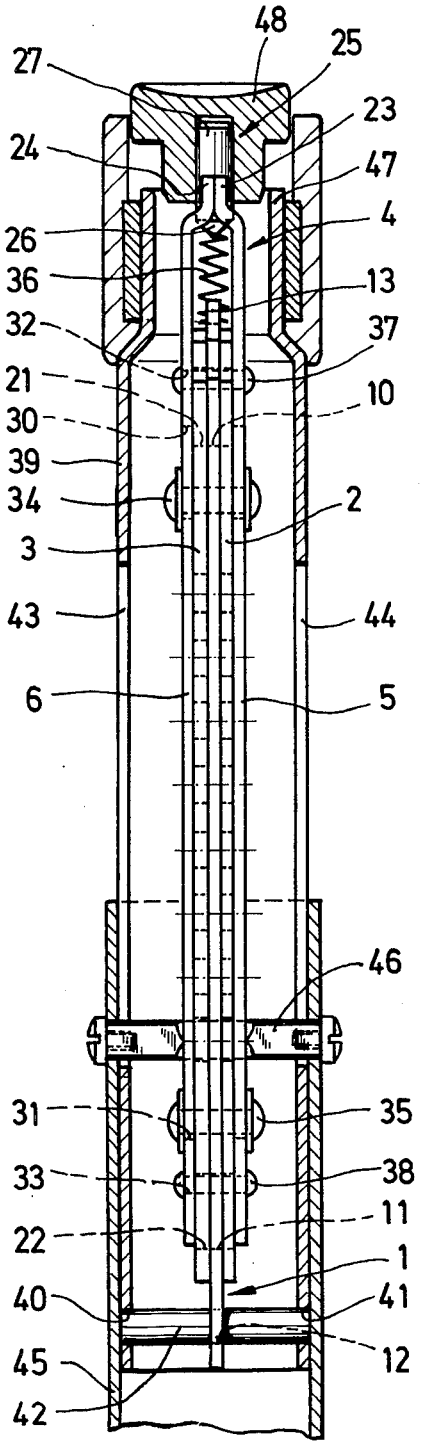
Figure 5:
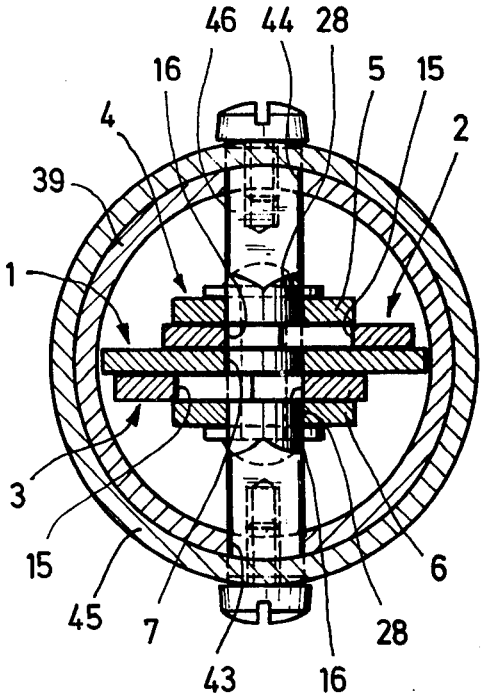
Figure 6:
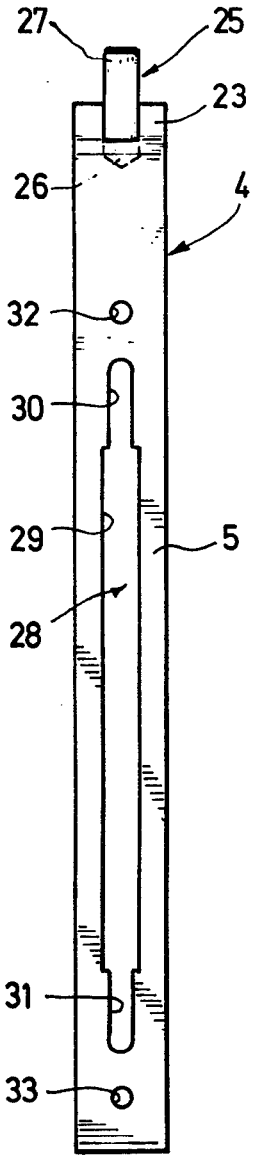
Figure 7:
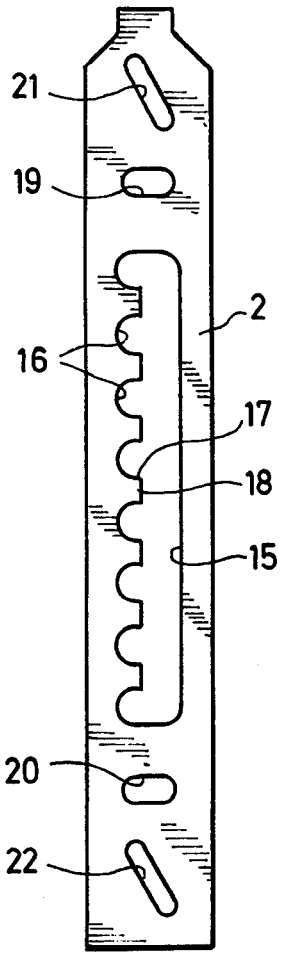
Figure 8:
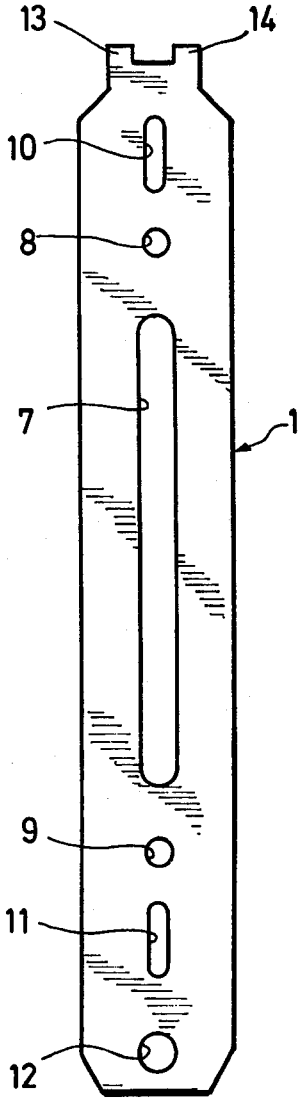

The following description of preferable forms of realization of the invention will provide a more detailed explanation in conjunction with the diagrams, which show:

In FIG. 1, a view of a chair with an adjustment mechanism according to the invention for height adjustment of the seat back;

In FIG. 2, a view of a height adjustment mechanism according to the invention, with the stop slides in the locking position;

In FIG. 3, a view similar to FIG. 2, with the stop slides in the open position;

In FIG. 4, a cross section along the line 4—4 in FIG. 2;

In FIG. 5, a cross section along the line 5—5 in FIG. 2;

In FIG. 6, a front view of one arm of the mover of the mechanism represented in FIGS. 2 through 5;

In FIG. 7, a front view of a stop slide of the mechanism represented in FIGS. 2 through 5;

In FIG. 8, a front view of the primary element of the mechanism represented in FIGS. 2 through 5.

In the following will be described a preferred form of execution of the adjustment mechanism according to the invention, with reference to FIGS. 2 through 5. The mechanism comprises an elongated, flat primary element 1, two stop slides 2 and 3, also long and flat, lying flat against opposite faces of the primary element 1, and a U-shaped mover 4, with arms 5 and 6, also elongated and flat, the inner faces of which lie against the outer faces of the two stop slides 2 and 3 (FIG. 4). The configuration of the arms of the U-shaped mover, of the stop slides, and of the primary element can be seen in FIGS. 6, 7 and 8.

The primary element 1 has in its central region a longitudinally running slot 7, at each end of which is a hole 8 and 9, and at a greater distance from the slot 7 at each end there is a slot 10 and 11, also running longitudinally, with the slots and holes arranged symmetrically with respect to the midline of the primary element.

At one end, also on the midline of the primary element, is placed an additional hole 12.

At the opposite end, the primary element is provided with two projecting flanges 13 and 14, the distance between which corresponds to the outside diameter of a compression spring to be described below.

The stop slides 7 also have a slot 15, which displays stop recesses 17 arranged at intervals along one long edge of the slot, opening to its center, while its other long edge is a straight line. The stop recesses have an essentially semicircular shape, with the centers of the stop recesses at a small distance from the side of the slot. From the semicircular curve of the stop recesses 16 there extends a section 17 running perpendicular to the side of the slot. Thus between adjacent stop recesses, there are projections 18 whose contours in the region near the slot run perpendicular to the extension of the slot.

The length of the slot 15 corresponds to the length of the slot 7 in the primary element 1.

At both ends of the slot 15, there are slots 19 and 20 running perpendicular to the longitudinal extension of the slot 15, the separation of which corresponds to the distance between the holes 8 and 9 in the primary element 1.

In addition, in the two end regions of the stop slide are provided obliquely running slots 21 and 22, the significance of which will be further clarified later.

The two stop slides 2 and 3 are identical in configuration, and the primary element 1 as well as the stop slides 2 and 3 are stamped sheet metal parts.

The arms 5 and 6 of the mover 4 are also stamped parts, which are bent at one end. In this region the laterally displaced end portions 23 and 24 lie flat against one another, and are attached together, for example by welding. These end portions form the shaft of the U-shaped mover.

The end sections 23 and 24 of the arms are punched in the center, so that an opening is formed in the shaft of the mover, through which is inserted a centering pin 25. The centering pin is welded to the mover in such a way that a conical end 26 projects through the shaft into the space between the two arms 5 and 6, while the opposite end 27 of the centering pin 25 extends outward beyond the end sections 23 and 24 of the mover 4 (FIG. 4). Both arms 5 and 6 of the mover have a slot 28 running along their midline, which is wider in its central region 29 than in its two end portions 30 and 31. The central region 29 is made to be somewhat longer than the slots 7 and 15 in the primary element and the stop slides respectively.

At each end of the slot 28 are holes 32 and 33, whose centers lie on the midline of the arm.

The components detailed above are brought together into an assembly in the manner to be seen from FIGS. 2 through 5. To this end the two identical stop slides are placed in opposite orientations on one side and the other of the primary element, and the bundle consisting of the primary element and the two stop slides is inserted between the arms of the mover, the distance between which precisely corresponds to the width of the bundle.

The attachment of these parts to one another is accomplished first by two pins 34 and 35, which pass through the end portions 30 and 31 of the slot 28 of the two arms, through the transverse slots 19 and 20 of the two stop slides, and through the holes 8 and 9 of the primary element. These pins can be for example rivets.

Through these two pins it is achieved that the two stop slides are held to the primary element, with the ability to shift in the direction perpendicular to its longitudinal extension, while the mover can be displaced parallel to the longitudinal extension with respect to the primary element.

Between the shaft of the U-shaped mover and the end of the primary element 1 opposite it is installed a compression spring 36, which at one end surrounds the conical end 26 of the centering pin 25, and on the other end bears against the end of the primary element. Lateral displacement of the compression spring 36 is prevented on the one hand by the flanges 13 and 14, and on the other hand by the inner face of the arms 5 and 6. (See FIGS. 2 and 4.)

Through the holes 32 and 33 of the arms, the oblique slots 21 and 22 of the stop slide, and the slots 10 and 11 of the primary element are further inserted carrier pins 37 and 38, which again can be constituted by rivets. These carrier pins held in the holes 32 and 33 of the mover can move with displacement of the mover, along the slots 10 and 11 of the primary element. In addition, with this motion they are displaced along the oblique slots 21 and 22 of the stop slides, which are then forced by consequence in the direction perpendicular to their longitudinal extension. The slots 21 and 22 are arranged in the stop slides in such a way that with the mover undisplaced, that is, with the spring 36 uncompressed, the stop slides are in a so-called locking position, in which the projections 18 arrayed between the stop recesses 16 partially cover the slots 7 and 28 in the primary element and the mover arms respectively. The exact position is determined by the slots 19 and 20 in the stop slides, which act as stops for the pins 34 and 35. In the locking position, the sides of the two stop slides with the stop recesses come together only so far that the openings formed by the paired stop recesses have portions perpendicular to the longitudinal extension of the slot 18. In other words, the stop slides do not come so close together that the semicircular curves of the stop recesses overlap directly.

With displacement of the mover against the action of the compression spring 36, the stop slides are pushed apart by the carrier pins 37 and 38 moving in the oblique slots 21 and 22, to such an extent that a gap running parallel to the slot 15 is formed between the projections 18. Preferably, this gap has the same width as the slot 7 of the primary element.

In the examples of execution represented in the drawing, the assembly thus far explicitly described is contained in a tubular component 39. For this, a mounting pin 42 is inserted through two opposing holes 40 and 41 in the tube 39, and through the hole 12 in the primary element, fixing the assembly witin the tube in the axial direction. The tube 39 has two opposing longitudinal slots 43 and 44, which are aligned with the slot 7 in the primary element, and of at least equal length.

The tube 39 slides in telescoping fashion within a tube 45, which bears a bolt 46 held in the two walls, passing diametrically through the tube. This bolt projects through the slots 43 and 44 in the tube 39, through the slots 29 in the two arms of the mover, through the slots 15 in the two stop slides, and through the slot 7 in the primary element.

The tube 45 provided with the bolt 46 will be designated in the following as the "secondary element," the distance of which from the "primary element 1" is adjustable by means of the mechanism heretofore described.

The tube 39 is open at its end 47 toward the tube 45. Through this opening, the mover 4 can be pushed. For this purpose, it is advantageous for it to have a push button 48 mounted on the projecting end 27 of the centering pin 25, which either projects out of the tube 39, or is arranged so that in the locking position, its surface is a bit below the rim of the tube. The latter arrangement has the advantage that the mover cannot be pushed inadvertently.

As represented in FIG. 1, the tube 39 can support the back rest of a chair, while the tube 45 takes the form of a back rest support, and is connected to the seat or the understructure of the chair.

In use of the adjustment mechanism according to the invention, the mover 4 is pushed, under the action of the compression spring 36, in such a way that the two stop slides are in the locking position, in which two opposite paired stop recesses of the two stop slides engage the bolt from both sides, and thus fix its position relative to the primary element.

To alter the separation between the primary and secondary elements, the mover 4 is pushed against the force of the spring 36. Thereby the two stop slides are pushed apart by the spreader comprised of the carrier pins 37 and 38 and the oblique slots 21 and 22 in the stop slides, until the gap formed between them enables free movement of the bolt 46 along the slots 7, 15 and 28. As soon as the desired position of the bolt is established, the mover 4 is again released, and returns to its initial position under the action of the spring 36, and thus in turn moves the two stop slides together again. Corresponding to the new position of the bolt 46, other paired stop recesses then engage the bolt, and fix it in its new position.

Because the openings formed by opposing stop recesses display sections perpendicular to the longitudinal direction of the slots 15 (adjustment direction), under loading the bolt is supported on these sections perpendicular to the adjustment direction. Thus it can exert no force on the two stop slides pushing them apart, so that these sections perpendicular to the adjustment direction ensure that under loading no inadvertent alteration of the distance between the two elements can result.

The manufacture of the mechanism according to the invention is extraordinarily simple, as is the assembly.

All significant components can be manufactured as stampings, with the mover easily manufactured from two stamped parts and the centering pin by welding.

For assembly, the components need merely to be placed upon one another in the proper arrangement, with the spring inserted between the centering pin and the primary element. Afterward, the pins 34 and 35 and the carrier pins 37 and 38 are inserted and fastened, which is particularly easy through the use of rivets.

The unit thus obtained is then inserted into the tube, and fastened by insertion of the mounting pin 42. The tube with the adjustment mechanism installed within it is then inserted into the outer tube 45, and the entire mechanism is assembled by insertion of the bolt 46, which can then be permanently attached to the outer tube 45, for example by riveting.

The described mechanism has the advantage that it is housed entirely with the two telescoping tubes, and from outside, the mechanism is completely unseen. This is particularly the case when the bolt 46 is riveted to the tube 45, since this can be done flush with the outer surface of the tube.

Actuation is extremely easy, it being necessary only to displace the mover by pressing the push button 48, and to release it again after completing the adjustment. The mechanism also provides the necessary security, since an inadvertent alteration of the separation of the two elements is not possible, due to the contour of the openings enclosing the bolt 46, perpendicular to the adjustment direction.

I claim:

1. Mechanism for stepwise adjustment of the distance between a primary element, attached to one part of a chair, and a secondary element attached to another part, characterized by: (a) two stop slides (2, 3) mounted on the primary element (1) to slide in the direction perpendicular to the adjustment direction, between an opening position and a locking position, (b) a number of stop recesses (16) in each stop slide (2, 3), one above another in the adjustment direction, placed on a first side of each stop slide which faces the other stop slide, and open to said first side, with the stop recesses (16) of the two stop slides (2, 3) lying opposite one another in pairs, (c) an elastic element (36) for pushing the stop slides (2, 3) into the locking position, (d) a bolt (46) passing between the stop slides (2, 3), perpendicular to the adjustment direction and to the direction of displacement of the stop slides (2, 3), attached to the secondary element, and (e) a spreader mechanism (21, 22; 37, 38), with a mover (4), mounted on the primary element (1) such that it can be shifted parallel to the adjustment direction to displace the stop slides (2, 3) out of the locking position into an opening position with the paired stop recesses (16) of the stop slides (2, 3) in the locking position engaging the bolt (46) from both sides, while in the opening position the bolt (46) can be moved parallel to the adjustment direction between the stop slides (2, 3).

2. Mechanism according to claim 1, unique in that the mover (4) of the spreader mechanism (2) bears carriers (37, 38) at a distance from one another in the adjustment direction, which engage obliquely running guideways (21, 22) in the two stop slides (2, 3).

3. Mechanism according to claim 2, unique in that the guideways consist of the long edges of slots (21, 22) placed in the stop slides (2, 3), through which the carriers (37, 38) project.

4. Mechanism according to claim 2, unique in that the carriers (37, 38) at the same time pass through slots (10, 11) in the primary element (1) running parallel to the adjustment direction.

5. Mechanism according to claim 2, unique in that the elastic element is a compression spring (36) bearing on the one hand on the mover (4), and on the other hand on the primary element (1).

6. Mechanism according to claim 1, unique in that for mounting of the stop slides (2, 3), slots (19, 20) running perpendicular to the adjustment direction are provided in them, through which pass pins (34, 35) attached to the primary element.

7. Mechanism according to claim 6, unique in that the pins (34, 35) additionally pass through slots (30, 31) in the mover (4) running parallel to the adjustment direction.

8. Mechanism according to one of the previous claims, unique in that the primary element (1) has the form of an elongated plate with a longitudinal slot (7), in that the two stop slides (2, 3) also consist of elongated plates, which lie flat against opposite faces of the primary element (1), such that in the locking position, the projection (18) between the stop recesses (16) partially cover the slot (7) in the primary element (1), and in that the mover (4) is of a U-shaped configuration, with two arms (5, 6) consisting of elongated plates, lying flat against the outside of the stop slides (2, 3), each arm (5, 6) having a slot (28) aligned with the slot (7) in the primary element (1).

9. Mechanism according to claim 8, unique in that the stop slides (2, 3) have longitudinal slots (15), one long edge of which bears the recesses (16) open to one side.

10. Mechanism according to claim 1, unique in that the stop slides (2, 3) are identical in construction, and are installed in the mechanism in mirror image fashion.

11. Mechanism according to claim 8, unique in that the primary element (1) and the stop slides (2, 3) are flat stamped parts.

12. Mechanism according to claim 8, unique in that into the shaft of the mover (4) connecting the two arms (5, 6) is inserted a centering pin (25) projecting to the inside, for a compression spring (36) bearing on the primary element (1).

13. Mechanism according to claim 12, unique in that the primary element (1) bears lateral flanges (13, 14) on its end toward the shaft, which retain the compression spring (36) bearing on the primary element in the direction perpendicular to the adjustment direction.

14. Mechanism according to claim 1, unique in that the mover (4) bears a push button (48).

15. Mechanism according to claim 1, unique in that the projections (18) between the stop recesses (16) have at their ends a region (17) running perpendicular to the adjustment direction, and that the stop slides (2, 3) have a distance between them in the locking position such that the opening formed by the pair of stop recesses (16) is bounded by these portions running perpendicular to the adjustment direction.

16. Mechanism according to claim 1, unique in that the assembly of the primary element (1), stop slides (2, 3) and mover (4) is placed inside a tube (39), and fastened within it by a rigid attachment of the primary element (1) to the tube (39), in that diametrically opposite slots (43, 44) are provided in the tube for the bolt (46) passing between the stop slides (2, 3), and in that the tube (39) moves in telescoping fashion within the secondary element (45) which is also in the form of a tube.

17. Mechanism according to claim 16, unique in that for attachment of the primary element (1) is provided a pin (42) passing through diametrically opposite holes (40, 41) in the tube (39) and through a hole (12) in the primary element (1).

18. Mechanism according to claim 1, unique in that the tube (39) is open on the end away from the secondary element (tube 45), so that through the open end, the mover (4) can be pushed.

19. Mechanism according to claim 1, unique in that to the primary element (1) a chair back rest is directly or indirectly attached, while the secondary element (45) is directly or indirectly attached to the chair.

* * * * *